US005953793A

United States Patent [19]

Röder

[11] Patent Number: 5,953,793

[45] Date of Patent: Sep. 21, 1999

[54] ROLL PRESSING DEVICE FOR A SLIVER DRAWING FRAME

[75] Inventor: Mario Röder, Mönchengladbach, Germany

[73] Assignee: Trützschler GmbH & Co. KG, Mönchengladbach, Germany

[21] Appl. No.: 09/020,823

[22] Filed: Feb. 9, 1998

[30] Foreign Application Priority Data

Feb. 8, 1997 [DE] Germany ..... 197 04 815

[51] Int. Cl.[6] ..... D01H 5/46

[52] U.S. Cl. ..... 19/266; 19/260; 19/267

[58] Field of Search ..... 19/236, 258, 260, 19/261, 266, 267, 271, 272, 273, 278, 294, 295

[56] References Cited

U.S. PATENT DOCUMENTS

| | | | |
|---|---|---|---|
| 2,890,495 | 6/1959 | Miesch et al. | 19/260 |
| 3,079,648 | 3/1963 | Schiltknecht | 19/278 |
| 3,200,446 | 8/1965 | Dausch | 19/267 |
| 3,310,847 | 3/1967 | Aurich | 19/258 |
| 4,398,320 | 8/1983 | Kubota et al. | 19/258 |
| 5,613,280 | 3/1997 | Mandl . | |

FOREIGN PATENT DOCUMENTS 0 143 291 6/1985 European Pat. Off. .

33 25 422 1/1984 Germany .

*Primary Examiner*—Michael A. Neas
*Assistant Examiner*—Gary L. Welch
*Attorney, Agent, or Firm*—Venable; Gabor J. Kelemen

[57] ABSTRACT

A textile sliver drawing unit includes a roller assembly for advancing and drawing a sliver running therethrough. The roller assembly includes an upper roll and a lower roll cooperating with the upper roll. The drawing unit further has a pressing device for pressing the upper roll against the lower roll during operation. The pressing device includes a pivotally supported pressing arm having an inwardly pivoted operational position and an outwardly pivoted inoperative position; a force-generating device carried by the pressing arm; a movable member coupled to the force-generating device and engageable at least indirectly with the upper roll for transmitting a force from the force-generating device to the upper roll for pressing on the lower roll; and a carrier element mounted on the pressing arm and being settable into locking and unlocking positions. In the locking position the carrier element locks the upper roll to the pressing arm, whereby the upper roll is moved away from the lower roll together with the pressing arm when the latter is pivoted from the operative position into the inoperative position. In the unlocking position of the carrier element the upper roll is released from the pressing arm, whereby the upper roll remains positioned on the lower roll when the pressing arm is pivoted from the operative position into the inoperative position.

18 Claims, 7 Drawing Sheets

FIG.7a
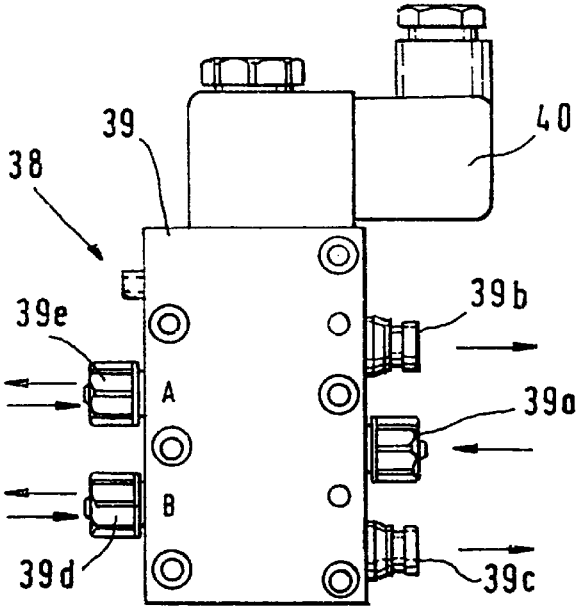
FIG.7b
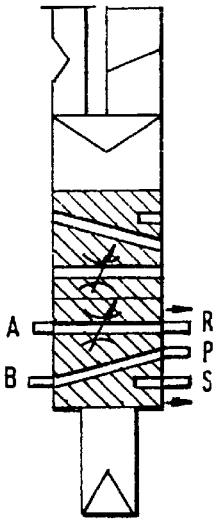
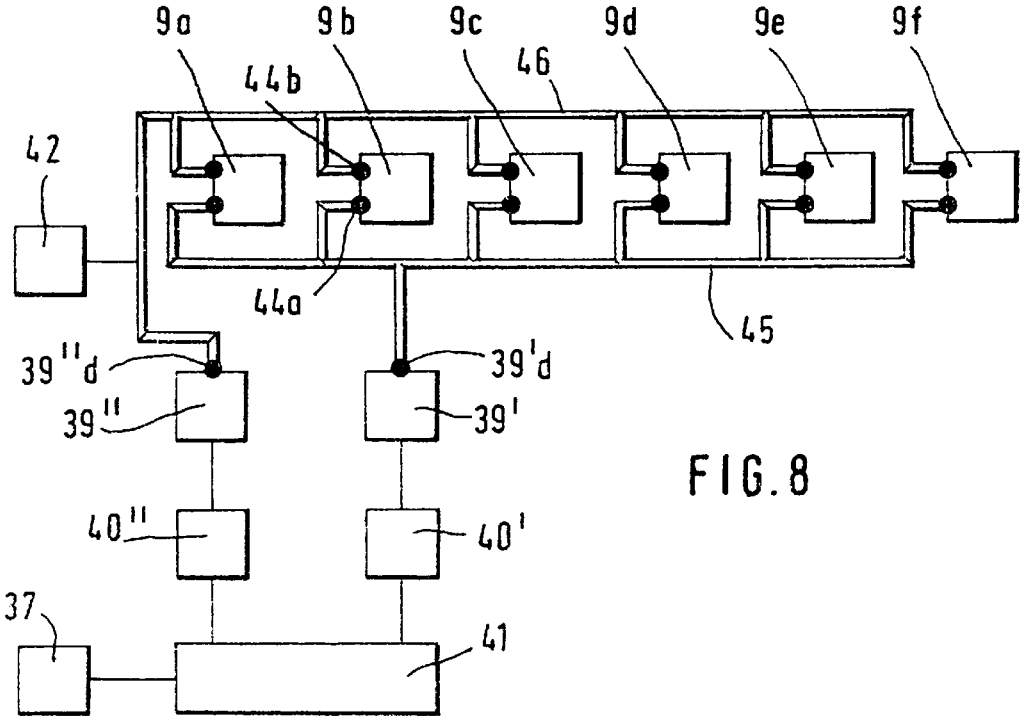
FIG.8

ROLL PRESSING DEVICE FOR A SLIVER DRAWING FRAME

CROSS REFERENCE TO RELATED APPLICATION

This application claims the priority of German Application No. 197 04 815.2 filed Feb. 8, 1997.

BACKGROUND OF THE INVENTION

This invention pertains to a drawing frame for textile slivers and is more particularly directed to a device for pressing down the upper rolls onto the respective lower rolls of the drawing unit which is composed of serially arranged roll pairs formed of upper and lower rolls. The pressing device has a pressing arm which carries a force-generating device, such as a pneumatic cylinder provided with a back-and-forth movable member, such as a pressure rod for pressing the upper roll against the lower roll. Further, the upper rolls may be moved away from the lower rolls into an inoperative position.

During operation, the pressing arms are closed and the pressing devices press the upper rolls onto the associated lower rolls of the drawing unit. In case the drawing frame is at a standstill particularly for a longer time period, the pressing arms are opened to thus release the upper rolls from the pressing forces for protecting the roundness of the rolls and their elastic coating against deformation. In a known arrangement the pressing arms are pivoted open manually while the upper rolls remain stationarily positioned on the lower rolls. In case of operational disturbances, for example, if sliver is wound around the upper roll, the latter is manually lifted off its holding device against its weight and after removal of the wound loops it is preferably immediately repositioned. For inserting the slivers (in case of processing a different fiber type), for cleaning the drawing frame, for installing or removing or setting an axial pressure bar carried by the pressing arm or, in case of loop formation about a lower roll, all upper rolls have to be removed. The manual removal of particularly a plurality of upper rolls is time consuming and labor intensive. It is a further disadvantage of the prior art arrangement that particular space is required for depositing the upper rolls. It is also a drawback that the sensitive upper roll, particularly its coating, is likely to be damaged if handled carelessly.

SUMMARY OF THE INVENTION

It is an object of the invention to provide a device of the above-outlined type from which the discussed disadvantages are eliminated and which, in a particularly simple and rapid manner makes possible an exposure of the lower rolls as well as a simple and rapid removal and replacement of the upper rolls.

This object and others to become apparent as the specification progresses, are accomplished by the invention, according to which, briefly stated, the textile sliver drawing unit includes a roller assembly for advancing and drawing a sliver running therethrough. The roller assembly includes an upper roll and a lower roll cooperating with the upper roll. The drawing unit further has a pressing device for pressing the upper roll against the lower roll during operation. The pressing device includes a pivotally supported pressing arm having an inwardly pivoted operational position and an outwardly pivoted inoperative position; a force-generating device carried by the pressing arm; a movable member coupled to the force-generating device and engageable at least indirectly with the upper roll for transmitting a force from the force-generating device to the upper roll for pressing on the lower roll; and a carrier element mounted on the pressing arm and being settable into locking and unlocking positions. In the locking position the carrier element locks the upper roll to the pressing arm, whereby the upper roll is moved away from the lower roll together with the pressing arm when the latter is pivoted from the operative position into the inoperative position. In the unlocking position of the carrier element the upper roll is released from the pressing arm, whereby the upper roll remains positioned on the lower roll when the pressing arm is pivoted from the operative position into the inoperative position.

Further, by providing a settable carrier element mounted on the pressing arm, the upper roll may be lifted off its support and thereafter pivoted upwardly (that is, lifted off its associated lower roll) together with the pressing arm by means of the force-generating device (such as a pneumatic cylinder) carried by the pressing arm. In this manner, the pressing element has the combined function of pressing down on the upper rolls during operation and of lifting the upper roll from the lower roll during standstill, at which time the upper roll is automatically released from pressure by the pressing arm lifting operation. During the upward pivotal motion which follows, the upper roll remains on the pressing arm so that no separate space is needed for depositing the removed upper roll and thus damaging thereof due to a careless deposition is securely avoided and further, a substantial exposure of the lower roll is achieved. By virtue of the fact that, as an alternative, the carrier element may remain out of engagement with the upper roll, an upward pivotal motion of the pressing arm may be carried out while leaving the upper roll in its support at the associated lower roll. In such an alternative operation too, the upper roll is released from load as the pressing arm is pivoted away. In case sliver looping around an upper roll occurs, the latter may be manually lifted off its support and after removal of the sliver loop, the upper roll may again be repositioned without the need of manipulating the securing elements therefor.

The invention has the following additional advantageous features:

Each upper roll is straddled by a portal-shaped pressing arm.

Two pneumatic cylinders (force-generating devices) are associated with each upper roll.

A settable actuating lever or the like is associated with the pressure rod of the pneumatic cylinder.

The actuating lever is rotatably supported at one end thereof.

The carrier lever projects into an opening provided in a holding component for the upper roll.

The carrier lever and the upper roll may be lifted upon withdrawing the pressing rod of the pneumatic cylinder.

A setting element is associated with the carrier lever.

A pneumatic valving device is provided which has at least three switching positions.

With each pneumatic cylinder two 5/2-way valves are associated.

With each pneumatic cylinder one 5/3-way valve is associated.

With each pneumatic cylinder two 3/2-way valves are associated.

The loading force for each upper roll is individually settable by a pressure regulator.

In the pressing arm a pivotal setting element is arranged.

The pressing arm is pivotal about a joint.

A switching element, for example, a manually operable pushbutton is provided for activating the pneumatic cylinder for the carrier element.

The switching element is connected to an electronic control and regulating device and the settable position is preselected.

BRIEF DESCRIPTION OF THE DRAWINGS

FIG. 7*a* is a schematic side elevational view of a pneumatic 5/2-way valve forming part of the structure according to the invention.

FIG. 7*b* is a symbolic representation of the pneumatic 5/2-way valve shown in FIG. 7*a*.

FIG. 8 is a block diagram of a microcomputer control and regulating device coupled to the pneumatic cylinders of the pressing arms by means of two valves.

DESCRIPTION OF THE PREFERRED EMBODIMENTS

Figure 1:
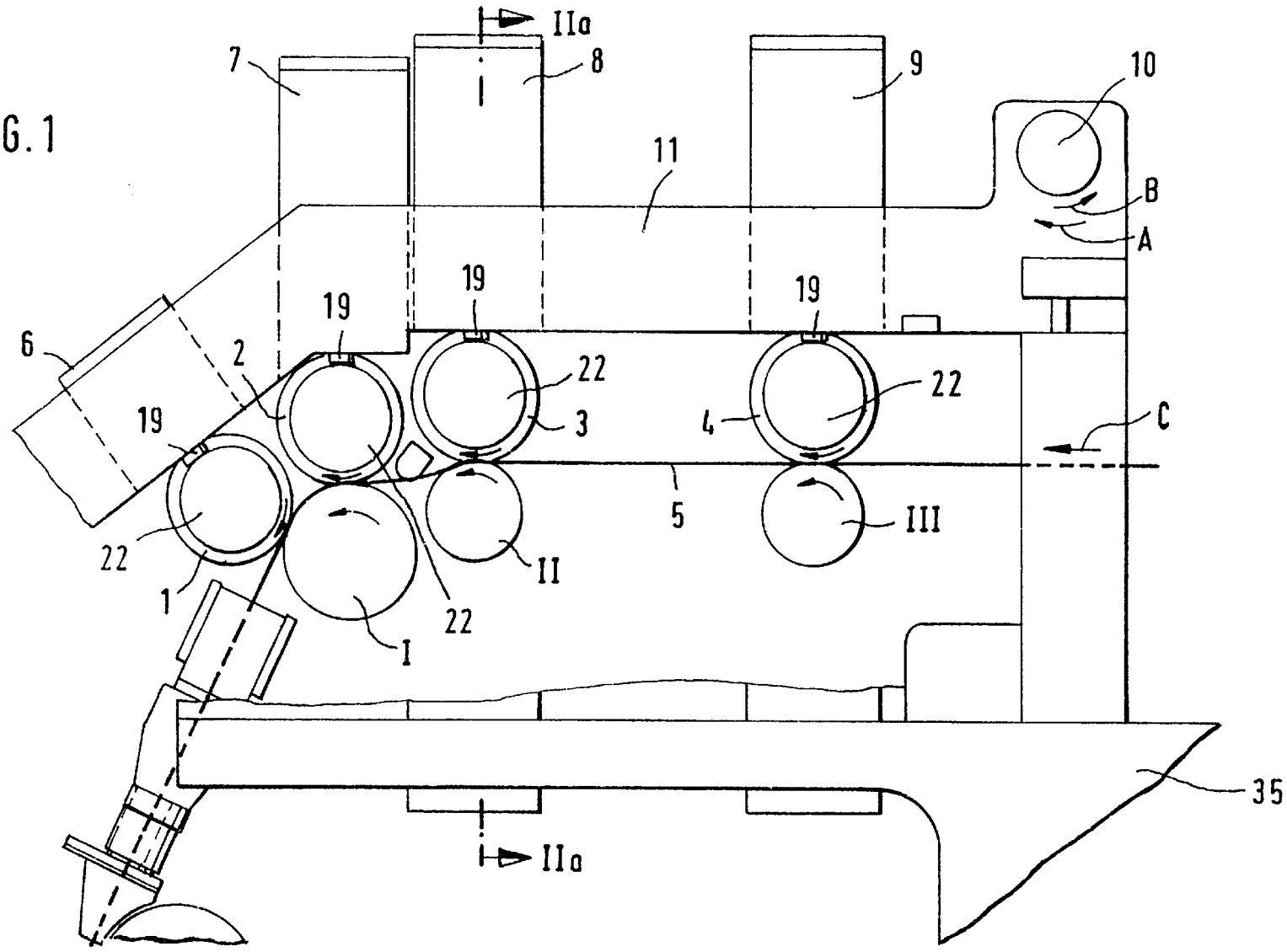
FIG. 1 is a side elevational view of a drawing unit incorporating the invention.

FIG. 1 shows a drawing unit forming part, for example, of an HS-model drawing frame manufactured by Trützschler GmbH & Co. KG, Mönchengladbach, Germany. The drawing unit is of the "4-over-3" type, that is, it is formed of three lower rolls I (lower output roll), II (lower middle roll) and III (lower input roll) and four upper rolls 1, 2, 3 and 4. The drawing unit drafts the sliver bundle 5 formed of a plurality of slivers and advancing through the drawing unit in the direction of the arrow C. The roll pairs formed of rolls 4 and III as well as 3 and II constitute a pre-drafting field while the roll pair formed of rolls 3 and II and the roll assembly formed of rolls 1, 2 and I constitute the principal drawing field.

The lower output roll I is driven by a non-illustrated principal motor which determines the output speed. The lower input roll III and the lower middle roll II are driven by a non-illustrated regulating motor. The upper rolls 1–4 are pressed against the respective lower rolls I, II, III by pressing devices 6, 7, 8 and 9 positioned in pressing arms 11 (only one is visible) rotatable in the direction of arrows A and B about a bearing 10. The upper rolls 1–4 are driven by the respective lower rolls I, II and III by frictional contact.

Figure 2A:
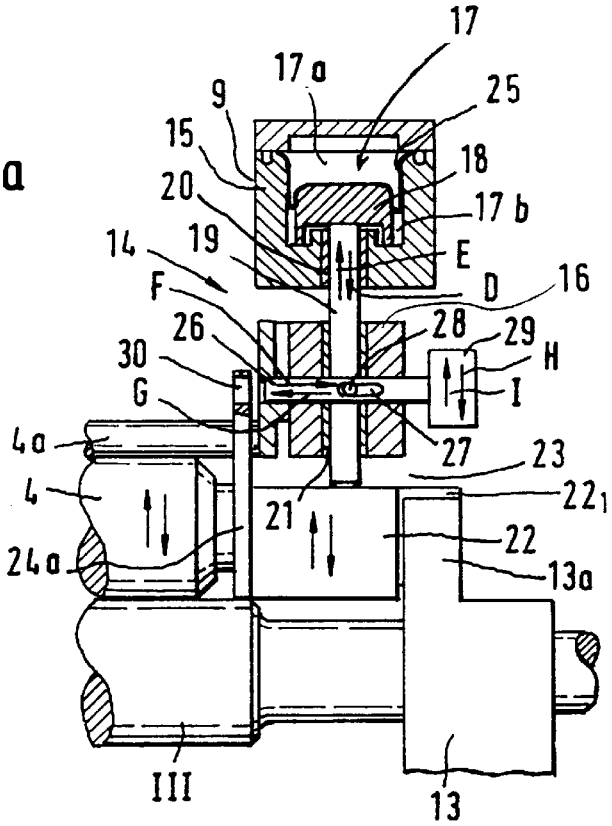
FIG. 2*a* is a sectional view taken along line IIa—IIa of FIG. 1.
Figure 2B:
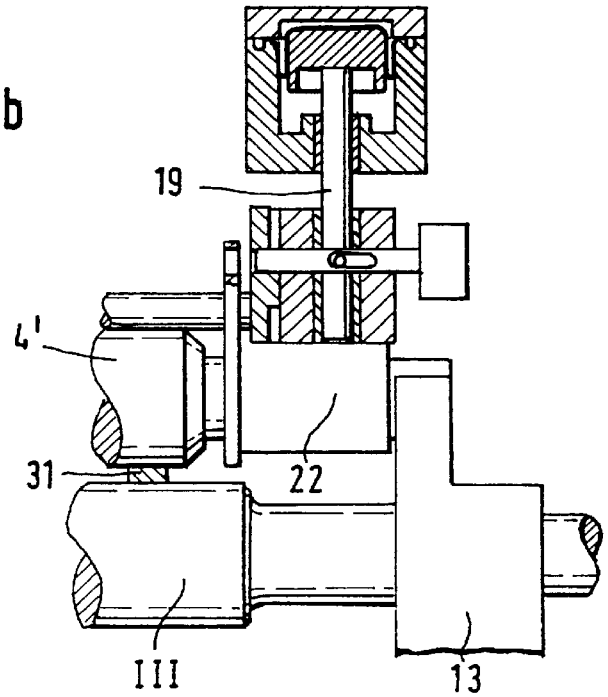
FIG. 2*b* is a view similar to FIG. 2*a*, showing the upper roll in a lifted position.

Also referring to FIGS. 2*a* and 2*b*, the lower rolls I, II and III are supported in bearing blocks 13 mounted on the machine frame 35. The pressing arms 11 also serve for shiftably receiving two pressing roll holders 14 for accommodating the upper rolls 1–4. Each upper roll holder 14 is composed of an upper part 15 and a lower part 16. The upper part 15 forms a cylinder unit having a cylinder chamber 17 in which a piston 18 is slidably received. A piston rod (pressure rod) 19 is attached to the piston 18 and is guided in a bore 20 of the upper part 15 and in a bore 21 of the lower part 16. The stub shaft 4*a* of the upper roll 4 projects through an opening of a holding plate 24*a* and is received in a bearing 22 which extends in a space 23 between the pressing roll holder 14 and the roll stub shaft of the lower roll III.

A diaphragm 25 which is in engagement with the face of the piston 18 divides the cylinder chamber 17 into an upper work chamber 17*a* and a lower work chamber 17*b* which may be selectively vented or charged with compressed air.

In operation, after a sliver bundle 5 has been positioned over the lower rolls I, II and III, the pressing arms 11 are pivoted inwardly (downwardly) into the working position illustrated in FIG. 1 and immobilized therein so that the upper rolls 1, 2, 3 and 4 may press the sliver bundle 5 against the lower rolls I, II and III. Such a pressing force is effected by the pressurization of the upper work chamber 17*a* of each pressing device 9, as a result of which the respective pressure rod 19—displaceable in the direction of the arrows D and E—presses down on the associated bearings 22 holding the upper rolls 1–4 which, in turn, press down on the respective lower rolls I, II, III. A carrier element formed as a slide pin 26 is mounted at an angle of 90° to the pressing rod 19 by a securing screw 28 and is shiftable in the direction of the arrows F and G relative to the pressing rod 19 by virtue of a slot 27 which is provided in the slide pin 26 and through which the securing screw 28 extends. The slide pin 26 is, at one end, supported in a bearing housing 29 which is shiftable in the direction of the arrows H, I' and in which a non-illustrated driving device is accommodated for shifting the slide pin 26. The holding plate 24*a* has a through-going opening 30 in alignment with the slide pin 26. By shifting the slide pin 26 in the direction of the arrow G, it may form-fittingly project through the opening 30.

If, as shown in FIG. 2*b*, a sliver loop 31 is formed about an upper roll or a lower roll, the upper roll of the roll pair where the sliver loop has been formed is shifted radially in the direction D against the resistance of the pressing rod 19 into the position 4', whereby the bearing 22 and the pressing rod 19 are likewise shifted in the direction D. At the same time a non-illustrated device for monitoring a loop formation is activated.

Figure 3A:
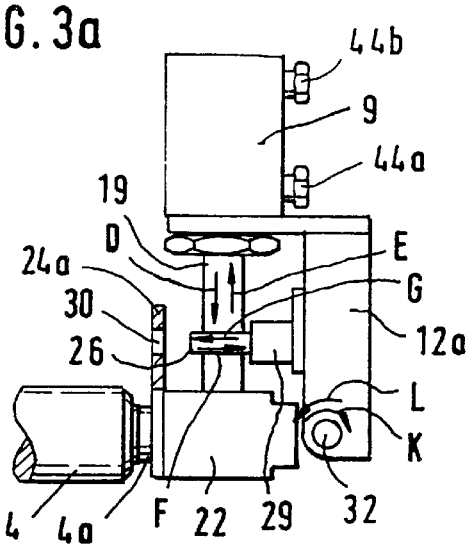
FIG. 3*a* is a front elevational view illustrating the device according to the invention, showing a downwardly pivoted pressing arm and a carrier element illustrated out of engagement with the upper roll.
Figure 3B:
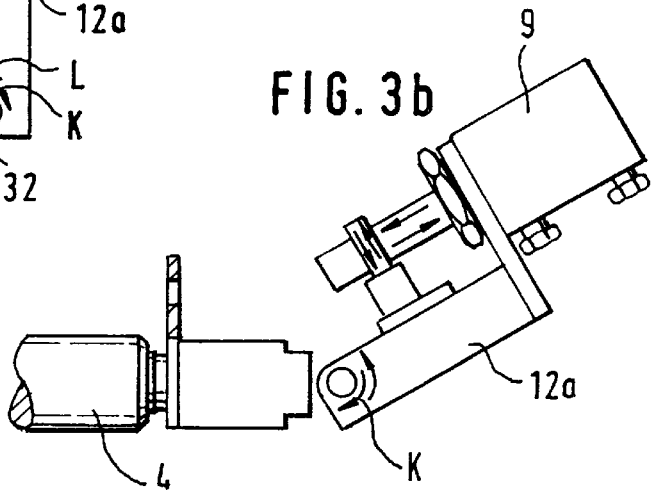
FIG. 3*b* is a view similar to FIG. 3*a* showing the pressing arm in an upwardly pivoted position, leaving the upper roll in place at the lower roll.
Figure 3C:
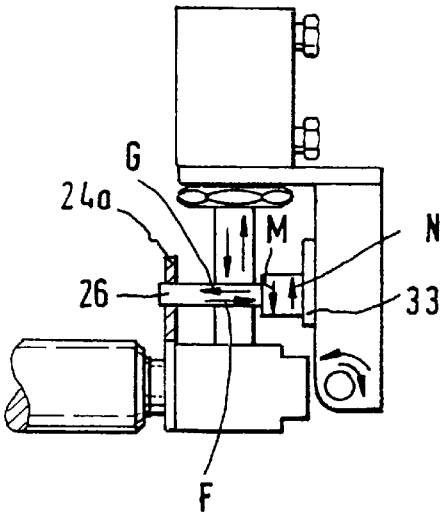
FIG. 3*c* is a view similar to FIG. 3*a*, showing the pressing arm in an downwardly pivoted position and illustrating the carrier element in engagement with the upper roll.
Figure 3D:
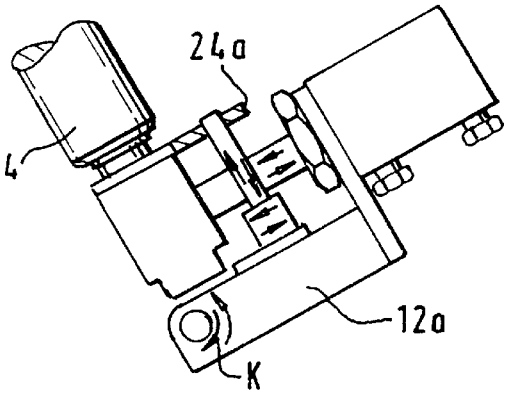
FIG. 3*d* is a view similar to FIG. 3*b* showing the pressing arm and the upper roll in an upwardly pivoted position.

In FIG. 3*a* the pressing arm 12*a* is shown in a downwardly pivoted state, and the pressing rod 19 of the pneumatic pressing device 9 presses on the bearing 22. The slide pin 26 is out of engagement with the holding plate 24*a*. The pressing arm 12*a* is rotatable in the direction of the arrows K, L about a rotary bearing 32. FIG. 3*b* shows the pressing arm 12*a* in an upwardly pivoted position which it assumes after it has been swung outwardly in the direction of the arrow K. Since the slide pin 26 is out of engagement with the holding plate 24*a*, the upper roll 4 remains in its position at the lower roll (not shown in FIG. 3*b*). In FIG. 3*c* the slide pin 26 projects through the opening 30 of the holding plate 24*a* after it has been shifted in the direction of the arrow G. Thereafter the pressing rod 19 is shifted in the direction of the arrow E. Also referring to FIGS. 2*a* and 2*b*, since the slide pin 26 is connected to the pressing rod 19 by means of the screw 28 (see FIGS. 2*a* and 2*b*), the holding plate 24*a*, together with the upper roll 4 is also lifted in the direction E to the same extent as the pressing rod 19. At the same time, the attachment $\mathbf{22}_1$ of the bearing 22 is lifted out of the supporting extension 13*a* of the stand 13. Also at the same time, the housing 29, which is shiftably supported by a slide bearing 33 at the pressing arm 12*a*, is also displaced in the direction of the arrow N through the same extent as the pressing rod 19. Thereafter the pressing arm 12*a*, as shown in FIG. 3*d*, is pivoted outwardly in the direction of the arrow K about the rotary bearing 32. Since the slide pin 26 is form-fittingly coupled with the holding plate 24*a*, the upper roll 4 is, together with the pressing arm 12*a*, pivoted outwardly and is thus pivoted away from the lower roll. The displacement of a slide pin 26 in the direction of the arrows F, G at the other, non-illustrated end of the upper roll 4 occurs in a similar manner.

Figure 4:
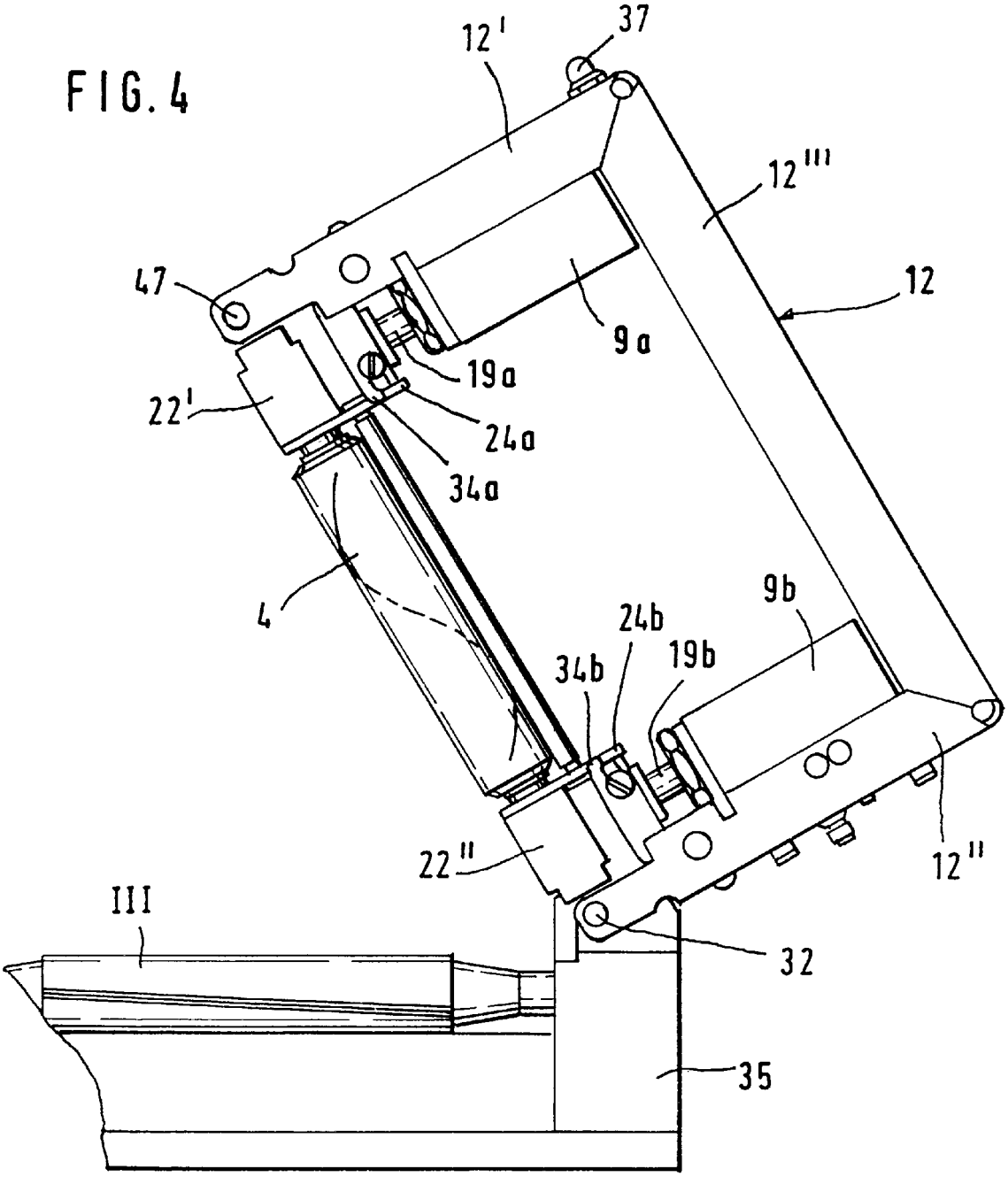
FIG. 4 is a front elevational view of another embodiment of the invention in which a portal-shaped pressing arm is shown in an upwardly pivoted position with the upper roll.
Figure 5:
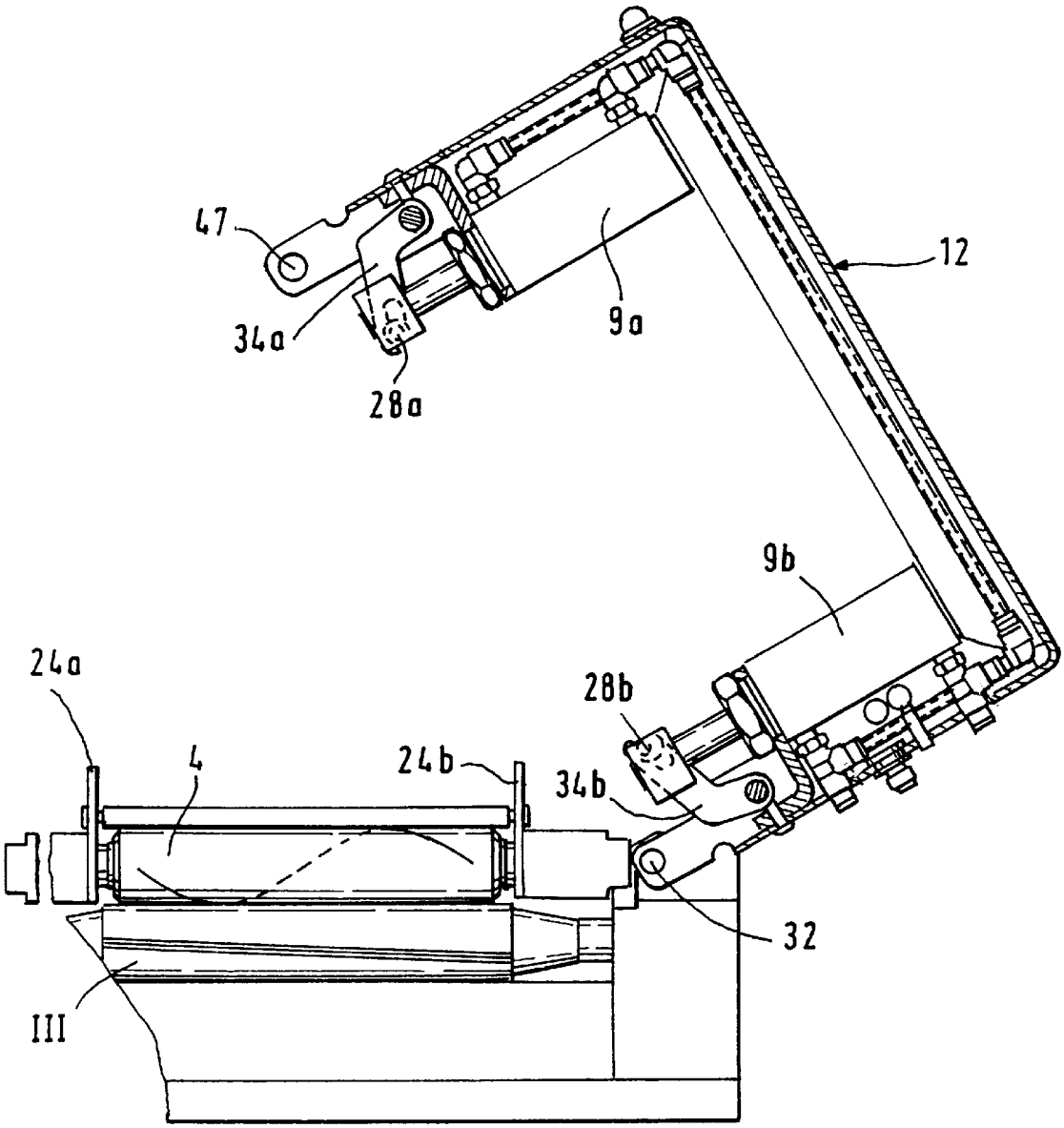
FIG. 5 is a view similar to FIG. 4 showing the pressing arm in an upwardly pivoted position, while leaving the upper roll in place at its associated lower roll.

According to FIGS. 4 and 5, with each upper roll 1–4 (shown only for the upper roll 4) a portal-shaped pressing arm 12 is associated which straddles the upper roll 4. The pressing arm 12 is composed of two lateral columns 12' and 12" and a traverse 12'". At the lateral columns 12', 12" a pneumatic pressing device 9*a* and 9*b* is mounted, having respective pressing rods 19*a*, 19*b* to which carrier elements formed as levers 34*a* and 34*b* are mounted by securing screws 28*a*, 28*b*.

As shown in FIG. 4, the pressing arm 12 has been pivoted upwardly about the rotary bearing 32 supported in the machine frame 35. The levers (carrier elements) 34*a*, 34*b* project into openings of the holding plates 24*a*, 24*b* in a form-fitting manner. As a result, the upper roll 4 is also pivoted upwardly. While according to FIG. 5 the pressing arm 12 of the FIG. 4 structure is also shown in an upwardly pivoted position, the levers 34*a*, 34*b* are out of engagement with the holding plates 24*a*, 24*b* so that the upper roll 4 is not pivoted outwardly but remains in the drawing unit in its usual, operative position. It is to be understood that the other upper rolls 1, 2 and 3 are also associated with a separate pressing arm 12 which operates identically to that described in connection with the upper roll 4. At the lower end of the lateral column 12' an opening 47 is provided through which a non-illustrated shiftable locking rod extends which is mounted on the machine frame 35. The lateral column 12' further carries a key 37.

Figure 6:
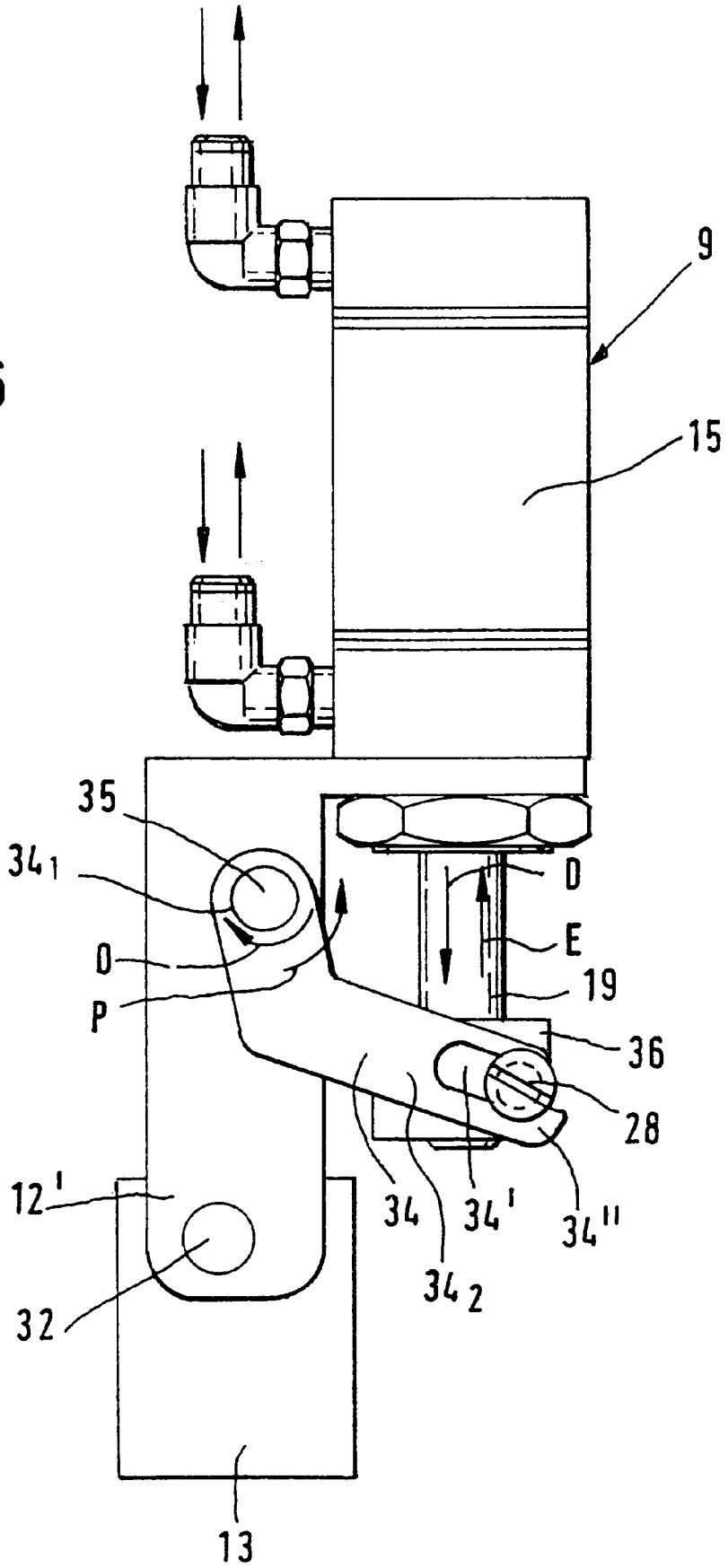
FIG. 6 is a front elevational view showing details of one part of a preferred embodiment of the invention.

Turning now to FIG. 6, the lever 34 constituting a carrier element is at one end $\mathbf{34}_1$ rotatably jointed for pivotal motions in the direction of the arrows O, P to a rotary bearing 35' which is secured to the lateral column 12' of the pressing arm 12. The lever 34 is a single lever crank, whose two arms are oriented at an obtuse angle to one another. The other end $\mathbf{34}_2$ of the lever 34 terminates in a fork 34' through which extends a pin 28 secured to an intermediate element 36 which, in turn, is mounted on the pressing rod 19. One tine of the fork 34' has a carrier attachment (carrier element) 34" which may project into the opening 30 of the holding plate 24*a* (not shown in FIG. 6). If the pressing rod 19 is shifted in the direction of the arrow E, the carrier element 34 pivots about the bearing 35' in the direction P and the carrier attachment 34" is shifted in the direction E in a circular path about the center of the bearing 35'. At the same time the lever 34 rotates in the direction of the arrow P and the opening 34' moves in the direction of the pin 28 so that the carrier attachment 34" projects beyond the pin 28 as the latter slides inwardly into the fork 34'. In this manner, the carrier attachment 34" is placed in a position in which it may project into the opening of the non-illustrated holding plate for the upper roll 4 (also not shown in FIG. 6). If the pressing rod 19 is shifted in the direction of the arrow D, all motions occur in the opposite direction.

The pneumatic control of the loading (pressure-applying) device of the drawing unit is effected by means of two 5/2-way valves as shown in FIGS. 7*a* and 7*b*. Also reverting to FIGS. 2*a* and 4, the following three switching positions may be obtained:

A. The piston 18 is charged with pressurized air in its upper dead center, that is, the upper rolls 1–4 are lifted as shown in FIG. 4. For lifting the upper roll 1–4, before releasing a lock from the aperture 47 at the lower end of the holding column 12', a key 37 arranged on the pressing arm 12 has to be depressed. As a result, the pistons 18 are shifted upwardly and the upper rolls 1–4 are immobilized with the aid of the levers 34*a* and 34*b*. The upper rolls 1–4 may then be pivoted upwardly together with the pressing arms 12.

B. The piston 18 is charged with pressurized air in its lower dead center, that is, the upper rolls 1–4 are loaded with pressure. The loading force applied to each upper roll 1–4 may be individually set by the pressure regulator 42. Also, the pressure is monitored by a pressure switch for safety reasons.

C. The piston 18 is in its lower dead center and is depressurized (vented), that is, the pressing arms may be pivoted upwardly without the upper rolls 1–4 (as shown in FIG. 5) because the latter are not locked to the respective pressing arms. This condition is obtained automatically when the machine is at a standstill. As a result of this operation, the upper roll coatings and the material are handled gently.

Turning to FIG. 7*a*, in the pneumatic valve 38 a solenoid 40 is operating a 5/2-way valve 39 which has a supply air inlet nipple 39*a*, a first venting nipple 39*b*, a second venting nipple 39*c*, a work nipple 39*d* (way 1) and a work nipple 39*e* (way 2). The arrows show the direction of the air flow. FIG. 7*b* is a symbolic representation of the operation of the 5/2-way valve 39. Dependent upon the state and direction of pressurization through the work nipple 39*d* three switching states may be obtained. The additional work nipple 39*e* may be blocked or may be utilized, for example, for a pneumatic control of the slide pin 26 (shown in FIGS. 2*a*, 2*b* and 3*a*–3*d*).

FIG. 8 illustrates an electronic control and regulating device 41 (microcomputer) to which the solenoids 40', 40" of respective 5/2-way valves 39' and 39" are connected. The valves 39', 39" are coupled to respective air lines 45, 46. All pneumatic cylinders 9*a*–9*f* are coupled to both air lines 45 and 46. With this arrangement the three pneumatic switching states described above under A., B. and C may be obtained for each pneumatic cylinder 9*a*–9*f*. Further, the key 37 (FIG. 4) is also connected to the control and regulating device 41. The air line 46 is coupled to a pressure regulator 42.

It is to be understood that for obtaining the above-described three switching states, two 3/2-way valves or a single 5/3-way valve may be used as alternatives. Also, while the invention was described in connection with pneumatic pressing elements, mechanical, hydraulic or electric pressing elements may be used in the alternative for loading the upper rolls 1–4.

It will be understood that the above description of the present invention is susceptible to various modifications, changes and adaptations, and the same are intended to be comprehended within the meaning and range of equivalents of the appended claims.

What is claimed is:

1. A sliver drawing unit comprising (a) a roller assembly for advancing and drawing a sliver running therethrough; said roller assembly including an upper roll and a lower roll cooperating with said upper roll; and (b) a pressing device for pressing said upper roll against said lower roll; said pressing device including (1) a pivotally supported pressing arm having an inwardly pivoted operational position and an outwardly pivoted inoperative position;

(2) a force-generating device carried by said pressing arm;

(3) a movable member coupled to said force-generating device and engageable at least indirectly with said upper roll for transmitting a force from said force-generating device to said upper roll for pressing on said lower roll; and (4) a carrier element mounted on said pressing arm and configured to be settable into locking and unlocking positions; in said locking position said carrier element locking said upper roll to said pressing arm, whereby said upper roll is moved away from said lower roll together with said pressing arm when said pressing arm is pivoted from said operative position into said inoperative position; in said unlocking position of said carrier element said upper roll is released from said pressing arm, whereby said upper roll remains positioned on said lower roll when said pressing arm is pivoted from said operative position into said inoperative position.

2. The drawing unit as defined in claim 1, wherein said pressing arm is a portal straddling said upper roll.

3. The drawing unit as defined in claim 1, wherein said force-generating device includes a fluid cylinder and said movable member includes a piston slidably received in said cylinder and a pressing rod connected to said piston.

4. The drawing unit as defined in claim 1, wherein said movable member is displaceable relative to said pressing arm by said force-generating device and further wherein said carrier element is secured to said movable member such that said carrier element is movable into said locking and unlocking positions thereof relative to said movable member.

5. The drawing unit as defined in claim 1, wherein said carrier element is substantially linearly slidable; further comprising a holding component for supporting said upper roll, said holding component being secured to said upper roll and having a locking opening into which said carrier element extends in said locking position thereof and from which said carrier element is retracted in said unlocking position thereof.

6. The drawing unit as defined in claim 5, further wherein said movable member has a first position in which said movable member contacts said upper roll and a second position in which said movable member is lifted off said upper roll in a displacement relative to said pressing arm; further comprising attaching means for mounting said carrier element to said movable member for displacing said carrier element by said movable member such that said carrier element is in said unlocking position when said movable member is in said first position and said carrier element is in said locking position when said movable member is in said second position.

7. The drawing unit as defined in claim 6, further comprising a manually operable switching member for energizing said force-generating device to move said movable member into said second position.

8. The drawing unit as defined in claim 6, further comprising an electronic control and regulating device; said force-generating device being connected to said electronic control and regulating device; a manually operable switching member for energizing said force-generating device to move said movable member into said second position; said manually operable switching member being connected to said electronic control and regulating device.

9. The drawing unit as defined in claim 6, further comprising valving means for setting said force-generating device into first, second and third switching states; in said first switching state said movable member is in said first position and said force-generating device is in an energized condition for pressing said movable member against said upper roll; in said second switching state said force-generating device is in an energized condition for lifting said movable member into said second position; and in said third switching state said movable member is in said first position and said force-generating device is in a de-energized condition; said valving means including a fluid-control valve having a valve-operating solenoid; an electronic control and regulating device; said fluid control valve being connected to said force-generating device for controlling fluid pressure therein; and said solenoid being connected to said electronic control and regulating device.

10. The drawing unit as defined in claim 6, wherein said attaching means comprises a rotary joint pivotally mounting said carrier element to said pressing arm.

11. The drawing unit as defined in claim 10, wherein said attaching means further comprises a pin attached to said movable member; further wherein said carrier element includes a forked end straddling said pin and a carrier projection extending from said forked end.

12. The drawing unit as defined in claim 6, further comprising valving means for setting said force-generating device into first, second and third switching states; in said first switching state said movable member is in said first position and said force-generating device is in an energized condition for pressing said movable member against said upper roll; in said second switching state said force-generating device is in an energized condition for lifting said movable member into said second position; and in said third switching state said movable member is in said first position and said force-generating device is in a de-energized condition.

13. The drawing unit as defined in claim 12, wherein said valving means comprises two 5/2-way valves.

14. The drawing unit as defined in claim 12, wherein said valving means comprises a single 5/3-way valve.

15. The drawing unit as defined in claim 12, wherein said valving means comprises two 3/2-way valves.

16. The drawing unit as defined in claim 5, further comprising a securing member affixed to said movable member and a slot provided in said carrier element; said securing member extending into said slot for holding said carrier element on said movable member and for allowing displacements of said carrier element into and out of said locking and unlocking positions relative to said movable member.

17. The drawing unit as defined in claim 1, further comprising a pressure regulator for regulating the force applied by said force-generating device to said movable member.

18. The drawing unit as defined in claim 1, further comprising an electronic control and regulating device; said force-generating device being connected to said electronic control and regulating device.

* * * * *